United States Patent [19]

Hirsimaki

[11] 4,001,551

[45] Jan. 4, 1977

[54] CALCULATOR

[76] Inventor: Paul A. Hirsimaki, 4106 Decatur St., Hyattsville, Md. 20781

[22] Filed: Nov. 1, 1974

[21] Appl. No.: 520,155

Related U.S. Application Data

[63] Continuation-in-part of Ser. No. 450,758, March 13, 1974, abandoned.

[52] U.S. Cl. ..... 235/70 A; 235/78 G; 235/88 G

[51] Int. Cl.[2] ..... G06G 1/10

[58] Field of Search ..... 235/70 R, 70 A, 78, 235/88, 89

[56] References Cited

UNITED STATES PATENTS

| | | | |
|---|---|---|---|
| 1,145,042 | 7/1915 | Spitzglass | 235/70 A |
| 1,602,479 | 10/1926 | Bulmer et al. | 235/70 A |
| 3,053,447 | 9/1962 | Azar | 235/70 A |
| 3,232,531 | 2/1966 | Hodge | 235/70 R |

*Primary Examiner*—Lawrence R. Franklin
*Attorney, Agent, or Firm*—Lane, Aitken, Dunner & Ziems

[57] ABSTRACT

A calculating device and a mechanical method of calculating win, place and show odds for events such as horse races having pari-mutuel wagering systems. The apparatus includes a base member and a pair of slideable members laterally displaceable relative to the base member. A transparent cursor having a hairline located thereon is also laterally displaceable relative to the base member and to the slideable members. In an alternative embodiment, the members and the cursor are rotationally displaceable relative to the base member. The device is arranged so that indicia on a first scale which represent the amount in a wager pool of interest may be positioned relative to a second scale so that the hairline on the cursor may be adjusted to the amount bet on a horse of interest. The win odds of the horse of interest may be directly read beneath the cursor on a third scale and those odds may be calculated in terms of dollars returnable for a given bet on a fourth scale. To calculate place odds, a reference representing track take-out on the second slideable member is set at the amount bet on the horse of interest on the first scale and the percentage of the pool wagered on the other horse which may be expected to share the pool is read on the second scale. The hairline of the cursor is then positioned adjacent to that percentage found on the indicia of the second slideable member so that the odds may be read on a place scale on the base member at the cursor hairline. Show odds are similarly calculated by summing the amount of the two additional horses which may be expected to share the show pool so that the odds on the horse of interest are read directly on a show scale on the base member.

8 Claims, 9 Drawing Figures

CALCULATOR

CROSS REFERENCE TO RELATED APPLICATION

This application is a continuation-in-part of copending application Ser. No. 450,758, filed Mar. 13. 1974, now abandoned.

BACKGROUND OF THE INVENTION

This invention relates to a calculating device for determining odds in a pari-mutuel wagering system. More particularly, this invention relates to a calculating device and a mechanical method for calculating win, place and show odds for events, such as horse races, having pari-mutuel wagering systems. Still more particularly, this invention relates to a mechanical method and calculating apparatus for calculating quickly the potential profit per dollar wagered for win, place and show bets by utilizing a knowledge of the amounts previously wagered on the contest.

By way of background, the three winning positions in a horse race are generally referred to as the "win" position (first), the "place" position (second), and the "show" position (third). The return on wagering for each position is determined from a number of factors and is important in determining on which horse and for what position a potentially profitable wager should be placed. For example, in wagering on the win position, the total amount of money in the win pool, i.e., the money wagered on entrants to win the contest, less a mutuel take from the pool which goes to the track and State, is available to return to holders of win tickets on the horse finishing in the win position. The pool profit is the returnable dollars minus the amount wagered on the winning entrant or winning entrants. The win odds, or the profit per dollar wagered on the winning entrant, is obtained by dividing the pool profit by the amount wagered on the winning entrant. The odds plus one, multiplied by the actual dollars wagered by a person on the winning entrant, provides the actual payoff for the winning wager to that person.

However, the calculations to determine the profit per dollar wagered to holders of redeemable place or show bets is more complicated. In wagering on the place position, the bettors entitled to share in the place pool are those who have wagered on the horses that finish in the win position or the place position. Thus, the amount wagered in the place pool on the horse that came in first and the amount wagered on the horse that came in second share the potential profit of the place pool. Similarly, the potential profit from the show pool is shared by the bettors who have wagered on the horses which came in first, second and third.

At a racetrack, the amount wagered on a particular horse in the win pool, the place pool and the show pool are generally illustrated, as are the total amounts in each of the respective pools. Moreover, the win odds for each horse are generally shown, although somewhat imprecisely since the odds value approximate the true value. However, it is a problem at a racetrack to evaluate quickly the likely place odds or show odds as well as the win odds with greater precision than that shown on the tote board. Occasionally, due to disproportionate amounts wagered on the entrants in the different pools a horse may pay as much or more to place or show as to win or pay as much or more to show as to place. Thus, an immediate knowledge of win, place and show odds, not now generally available, is important information for wagering decisions in parti-mutuel systems.

At racetracks with pari-mutuel wagering on horse racing, for example, the approximate win odds are provided on a tote board. However, for place and show wagering, the only data generally readily available are the amounts wagered on each horse for each pool and each wagering pool total. To obtain the place or show odds of a wager, a person must use that wagering data in a complex calculation shown below.

The calculation to obtain the place or show odds is as follows:

$$\text{ODDS} = X \left[ \frac{P-t-(a+b)}{a} \right] \tag{1}$$

where:

- x = the share of the pool profit awarded to the bet, the odds of which are being calculated, and, specifically, at United States tracks, x = ½ for place and ⅓ for show;
- $p$ = the total amount in either the place or the show pool, depending on whether the place or show odds are being calculated;
- $t$ = the amount withheld as a mutuel take, or track take, where $t$ is about 0.16p at United States tracks or 16% of the total wagers in the pool;
- $a$ = amount wagered on the bet, the odds of which are being calculated; and
- $b$ = amount wagered on the other bet sharing the place pool profits or the amount wagered on the other two bets sharing the show pool profits.

It can be seen that the odds are influenced by the amount wagered on the other pool-sharing bets designated by "$b$" in Eq. 1. In a field of N horses, there are N-1 possible payoff combinations with the other place qualifying horse for each horse to place. For the show pool, there are [(N−2) + (N−3) + ...1] possible payoff combinations with the two other show qualifying horses for each horse to show. The place or show odds of a horse for any combination is found by inserting the appropriate value of "$b$" into the equation.

The method and apparatus of this invention can be advantageously used for quickly calculating the minimum place or show odds by using the maximum value of $b$, or for relatively precisely calculating win, place or show odds without resort to the tedious use of the equation above. Adding to the possible calculative workload is the periodic updating of the wagering amounts provided on the tote board, which makes repetitive calculation desirable.

Still another factor in influencing the odds is the mutuel take $t$ which generally will vary from State to State. For this reason, a method for taking into account this variable mutuel take factor is also desirable.

In view of the value of knowing place and show odds, the number of possible payoff combinations which may be calculated, and the periodic updating of data, it is a principle object of this invention to provide by a simple mechanical calculation on an easily usable calculator the place or show odds of a bet for whatever combination of horses the wagerer desires.

It is another general object to provide for obtaining many possible payoff combinations of a bet with a minimum amount of readjustment on an odds calculator.

It is another object of this invention to provide for updating wagering data with a minimum amount of readjustment on an odds calculator.

It is another purpose of this invention to provide win odds of greater precision than are generally provided on the tote board at a racetrack.

It is still another object of this invention to enable odds calculations for different percentages of tax-track mutuel take.

An improved understanding and other objects and purposes of the invention will be apparent from reading the following detailed description of the invention and the accompanying drawings.

BRIEF SUMMARY OF THE INVENTION

Directed to overcoming the shortcomings of the prior art and to achieving the aforestated objects and aims of this invention, the apparatus according to the invention relates to a calculating device and a mechanical method for calculating win, place and show odds for events, such as horse races, having pari-mutuel wagering systems.

The calculator comprises a base member, first and second slideable members which are laterally displaceable relative to the base member and a cursor which at least partially envelops the base member and the slideable member. Preferably, the cursor is transparent and contains a hairline thereon.

A plurality of scales, each having indicia representing various items of interest in calculating wagering odds, are located on the base member and on the slideable members. A B scale located on the lower portion of the base member is a double logarithmic scale representing wagering pool percentages. An A scale is located on a first slideable member adjacent to the B scale. The A scale is a triple logarithmic scale adapted so that the total amount in a wagering pool of interest may be placed adjacent the 100 indicia on the B scale. Then, by moving the cursor along the calculator so that the hairline is set above the amount wagered on the horse of interest on the A scale, the odds on a "Win" scale located on the base member may be directly read. A "Place" scale and "Show" scale on a base member provide the place and show odds respectively. The base member of the calculator may also include a "$" scale adjacent to the Win, Place or Show scale for translating the odds into dollars to be paid off, for example, for each $2 bet. Thus, the base member includes the B scale, the Win scale, the Place scale, the Show scale and the $ scale, while the first slideable member includes the A scale.

In order to calculate place odds, the total amount of money wagered in the place pool is located on the A scale and is set adjacent the one hundred index on the B scale. The amount wagered on the horse of interest is located on the A scale and the setting reference located by the zero index of the C scale is set adjacent thereto. The amount of money wagered on a horse in the place pool which is likely to share in the place pool with the horse of interest is found on the A scale, and the percentage of the total amount wagered in the place pool corresponding thereto is found adjacent to it on the B scale. The cursor hairline is then set at the percent wagered on the other place pool sharing horse on a C scale. Thereafter, the place odds for the horse of interest may be read directly beneath the hairline of the cursor on the "Place" scale found on the base member.

Similarly, to calculate show odds, the amount of money wagered in the show pool on the two horses likely to share the show pool with the horse of interest is summed and the perecentage of the show pool for those two horses determined.

This percentage replaces the percentage, above, wgered on the horse sharing the place pool. All other steps are the same for finding the place odds. The odds under the hairline are read from the "show" scale, however.

In an alternative embodiment, these scales are placed upon circular members joined at their center to provide a circular calculator.

DETAILED DESCRIPTION OF THE PREFERRED EMBODIMENTS

Figure 1:
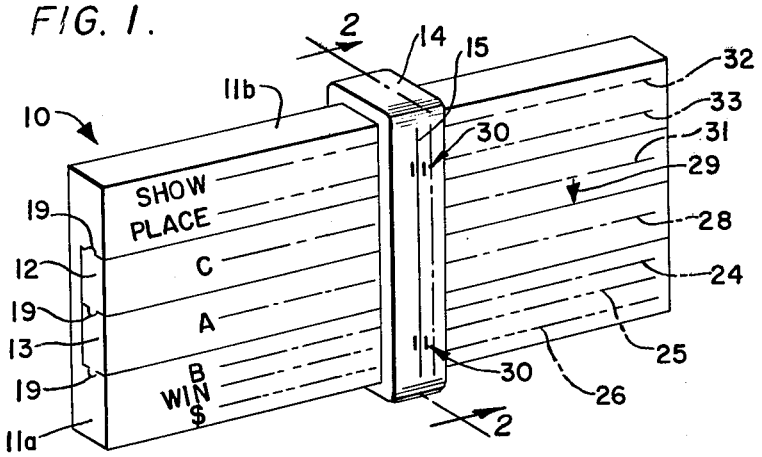
FIG. 1 is a perspective view of the device according to the invention.
Figure 2:
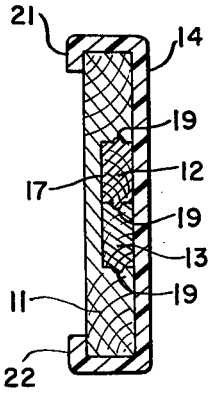
FIG. 2 is a cross-sectional view of the device taken along line 2—2 of FIG. 1.

In FIGS. 1 and 2, the calculator according to the invention is designated generally by the reference numeral 10. The basic physical components of the calculator 10 include a base member 11, slideable members 12 and 13, each of which is laterally displaceable relative to the base member 11, and a slideable cursor 14 overlying the base member 11 and having a hairline 15 disposed thereon. Preferably, the base member 11 has a channel 17 containing a groove in the side walls thereof for receiving mating tongues 19 on the side walls of the slideable members 12 and 13. Thus, the slide member 12 has a pair of laterally-opposed tongues 19 respectively disposed in a pair of laterally-opposed mating grooves in the channel 17 and slideable member 13. Similarly, the slide member 13 has a laterally-opposed tongue 19 disposed in a laterally-opposed groove in channel 17 and, further, is provided with a groove to receive the laterally-opposed mating tongue of the member 12. The base member 11 and each of the slide members 12 and 13 have indicia on the surface thereof for reasons which will be explained.

The cursor 14 is preferably transparent and is attached about the base 11, as shown in FIG. 2, by inwardly-extending ears 21 and 22, respectively. Alternatively, the cursor 14 can be made to envelop the base member. In each case, the cursor 14 is laterally slideable along the base member 11 to position accurately the hairline 15 relative and normal to the indicia on the base member 11 and the slideable members 12 and 13.

The cursor 14 may also include indicia 30 to compensate for tax-track take so that if the take at the track of interest is different from the take corresponding to the odds read at the hairline 15, the odds corrected to the proper tax-track take can be read at the associated indicia 30.

The base member 11 includes on a surface of its lower portion 11a, a plurality of scales 24, 25 and 26, designated "B," "Win" and "$" respectively. The B scale 24 is indicated for simplicity by a dashed/dotted line, it being understood that the B scale comprises indicia which will later be discussed particularly in connection with FIGS. 5–7. Similarly, the Win scale 25 is shown by a dashed/double-dotted line and the $ scale is shown by a dashed/triple-dotted line both of the latter scales in reality including indicia. On a surface of its upper portion 11*b*, the base member 11 includes a "Place" scale 33 and a "Show" scale 32 represented by a dashed/triple-dotted line and a dashed/double dotted line, respectively.

The B scale 24 is a double logarithmic scale numbered, by way of example, from 1 to 100, wherein the spacing of the indicia is proportional to their base 10 logarithm, for example. The numbers on the B scale 24 represent wagering pool percentages ranging, of course, from 1 to 100 per cent. The use of the B scale in calculating odds is explained in connection with FIGS. 5–7.

The Win scale 25 is an answer scale which provides win odds. The indicia on the Win scale 25 thus range in the manner in which win odds may range over some convenient scale. The $ scale 26 translates the odds given directly above on the Win scale 25 to the corresponding payoff value of a $2 bet and is provided for convenience. The indicia on the $ scale 26 could also be set to translate the odds on the Win scale 25 to other betting denominations.

Figure 5:
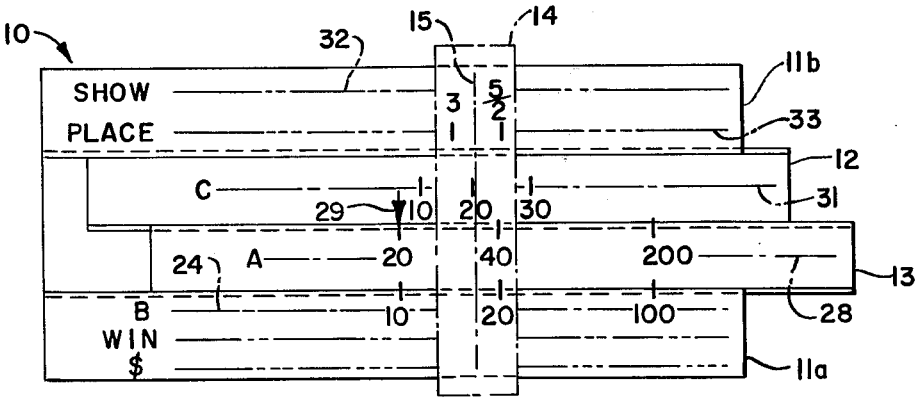
FIG. 5 is a partial view of the device according to the invention for use in explaining the calculation of place odds.
Figure 6:
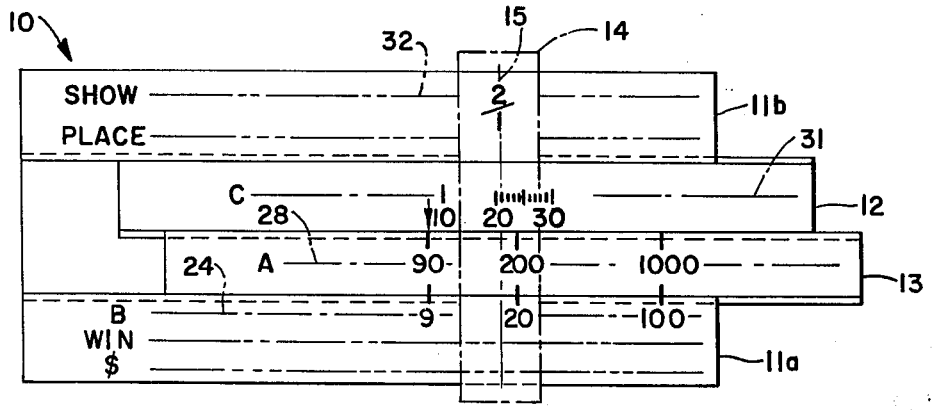
FIG. 6 is a partial view of the device according to the invention for use in explaining the calculation of show odds.

The Place scale 33 and the Show scale 32 are answer scales which provide place and show odds, respectively. The odds on a calculator shown in FIGS. 5 and 6 are for $X = ½$ and $X = ⅓$ for place and show, respectively, referring to Equation 1. These scales can be modified for other distribution factors.

The slideable member 13 has a triple logarithmic scale 28 containing indicia numbered by way of example, from 1 to 1000, and spaced proportionately to their base 10 logarithm, for example. The scale 28 is designated for illustration purposes by the letter A and indicated by a dashed/dotted line. The numbers on the A scale 28 represent actual wagering amounts in a wagering pool under study adjusted to a suitable power of 10. In most cases, the order of magnitude of the actual wagering figures representing the actual amount in a particular wagering pool must be adjusted (e.g., divided by 10 or 100 or the like), in order to perform the calculations explained hereafter, which adjustments are well known to those in the calculating act. When the amount in the wagering pool of interest on the A scale 28 on the slideable member 13 is set above the 100 indicia of the B scale 24 on the base member 11, the pool percent of any intermediate amount found on the A scale 28 can be read directly below that amount on the B scale 24. Thus, referring briefly to FIG. 5, for example, if the amount in a place pool is $20,000, the 200 indicia is aligned with the 100 indicia on the B scale. Thereafter, with the setting unchanged, $2000 wagered on a horse represents 10 percent of the pool, $4000 represents 20 percent of the pool, and the like. A study of examples of FIGS. 5–7 will verify this relationship.

Figure 9:
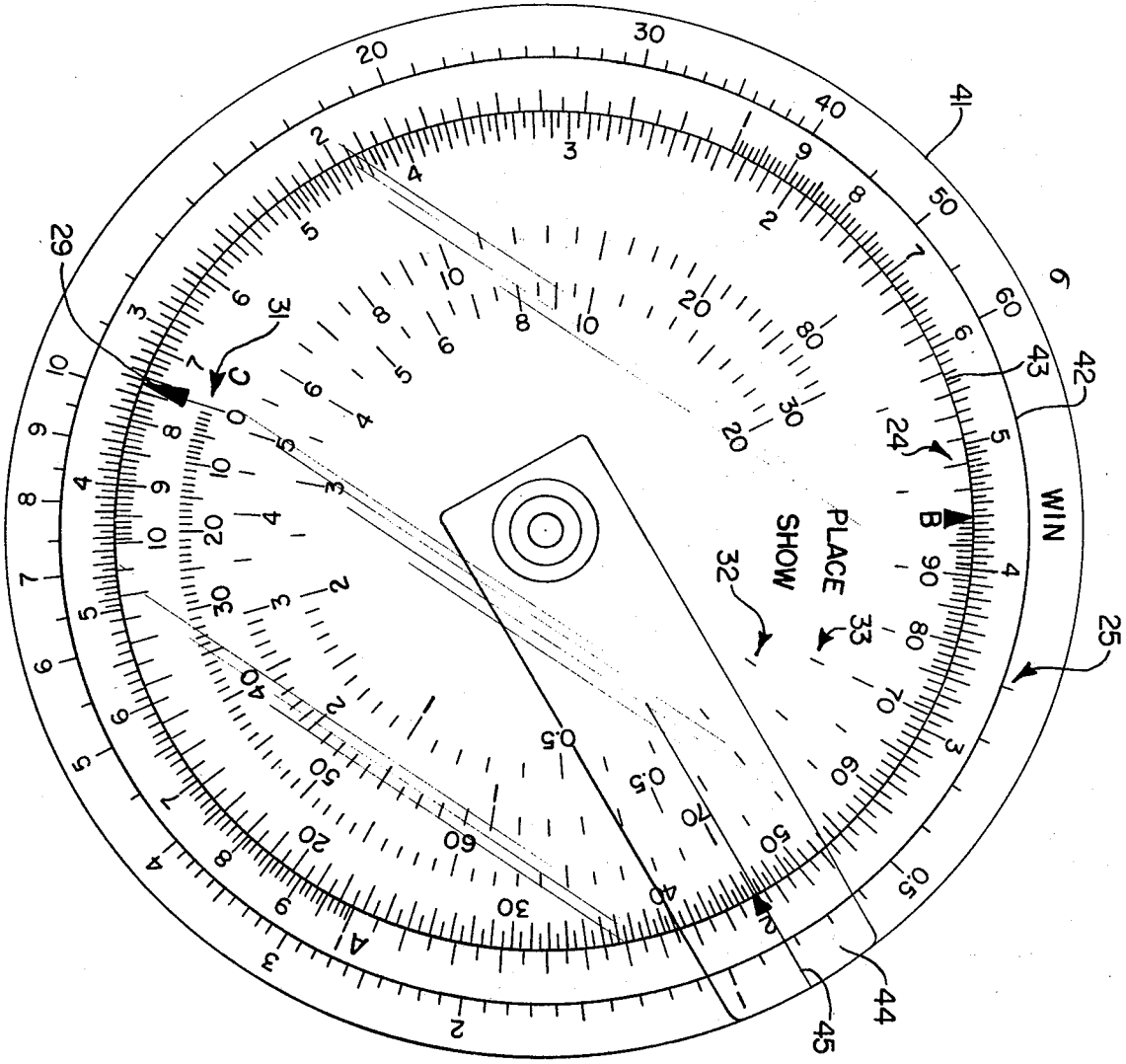
FIG. 9 is an enlarged plan view of a circular embodiment of the invention showing in detail the relationship of the various indicia on the components of the device.

Further, as is apparent from the examples, when the A scale is selected as a triple logarithmic scale, the B scale would occupy two-thirds of the linear distance of the A scale across the length of the calculator. A triple logarithmic A scale is employed to permit easier placement of the decimal point by the user of the calculator. In the alternative, the A scale could be a double logarithmic scale in which case it would occupy the same linear distance as the linear distance occupied by the B scale. FIG. 9 shows an embodiment wherein the A and B scales are both double logarithmic scales.

Movable slideable member 12 includes a setting reference 29 and a C scale 31. For simplicity, the C scale 31 is shown as a dashed/dotted line and represents the pool percentage wagered on the other place pool sharing horse or other two show pool sharing horses.

The odds represented by the indicia on the Win scale 25, Place scale 33 and Show scale 32 have taken into account the subtraction of the 16% track take from the corresponding pool. Indicia 30 to compensate for other pari-mutuel takes can also be provided. Except for calculations involving low odds and borderline readings, the use of other indicia 30 should not be necessary when a slightly different take is being used.

Alternatively, the compensating indicia 30 may be disposed adjacent the setting reference 29. In which case, the indicia corresponding to the correct tax-track take rather than the setting reference 29 would be set at the amount wagered on the horse of interest.

The A scale 28, the B scale 24, the C scale 31, the Win scale 25, the $ scale 26, the Show scale 32 and the Place scale 33 can all be modified to cover a wider or narrower range. Moreover, the corresponding payoff value of any denomination bet can be substituted for the odds provided on the Show scale 32 and the Place scale 33.

Figure 3:
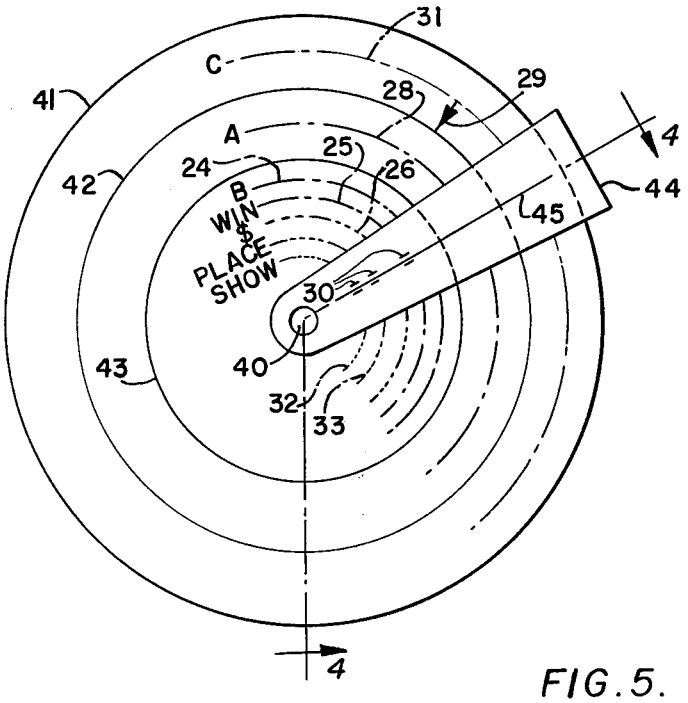
FIG. 3 is a plan view of a modified form of the device according to the invention.
Figure 4:
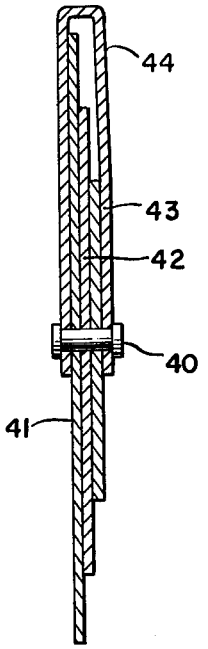
FIG. 4 is a cross-sectional view of the modified form of the device taken along line 4—4 of FIG. 3.

FIG. 3 is a plan view of an alternate embodiment of the calculator shown in FIG. 1 in which the various scales and indicia are provided upon circular structural elements. Scales which are shown in FIG. 1 and identified by reference numerals and other identifying indicia are similarly shown in the structure of FIG. 3.

The embodiment of FIG. 3 includes a first circular member 41 having a diameter greater than a second circular member 42 which in turn has a diameter greater than a third circular member 43. The circular members 41, 42 and 43 are joined in a rotatable relationship at their center by a fastening member 40. A rotatable cursor 44 having a hairline 45 and indicia 30 for compensating for various tax-track take is similarly fastened by the fastening member 40 in a rotatable relationship with the circular members 41, 42 and 43 so that the functions which can be performed in connection with the embodiment of FIG. 1 on a linear scale can also be performed with the embodiment of FIG. 3 on a circular scale.

Thus, the second circular member 42 corresponds to the slideable member 13 and includes an A scale 28 thereon. The third circular member 43 includes the B scale 24, the Win scale 25, the S scale 26, the Place scale 33 and the Show scale 32 thereon. The first circular member 41 includes the C scale of 31 and setting reference 29. Accordingly, any calculations which can be performed on the embodiment of FIG. 1 can also be performed on the embodiment of FIG. 3.

The circular embodiment may take other forms such as those enabled to be used with a transparent material permitting indicia to be read through other members in which case, the relative member diameters may vary.

Figure 7:
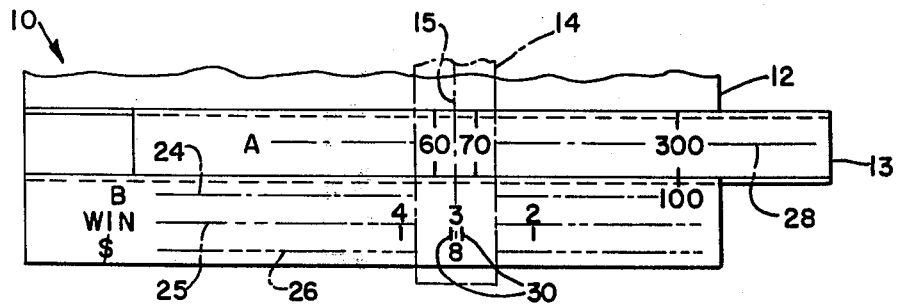
FIG. 7 is a partial view of the device according to the invention for explaining the calculation of win odds.

The following instructions and examples provided with reference to FIGS. 5–7 will give a fuller understanding of the use of the invention. FIGS. 5–7 do not necessarily represent true relative spacing of the scales, but provides a basis for illustrating the method of performing various calculations.

FIG. 5 provides a suitable basis for discussing the calculation of place odds. It is assumed for purposes of this example that from the tote board at the track, it is determined that the amount in the place pool is $20,000, that the amount in the place pool on horse X is $2000 and that the amount in the place pool wagered on horse Y is $4000.

In order to calculate the place odds on horse X which is the horse of interest, it is first necessary to slide the slideable member 13 with the A scale 28 so that the amount in the place pool, i.e., $20,000, adjusted to a suitable order of magnitude, i.e., 200, is set above the 100 indicia of the B scale 24 on the lower portion of the base member 11.

Then, without changing that relationship, the setting reference 29 of the slideable member 12 is set at the amount wagered on horse X found on the A scale which in this case is 20 since $2000 was wagered on horse X.

Then, it must be decided which other bet will share the place pool profit with the bet whose odds are being calculated. For example, horse Y on which $4000 has been wagered in the place pool is selected and the percent of the pool wagered on horse Y is read, which in this case is 20%, since the 20 indicia on scale B is directly beneath the 40 indicia on scale A. Thus, directly below the total amount wagered on the other pool sharing bet,i.e., horse Y, for example, the pool percent of the B scale 24, i.e., 20%, is read.

Then, the cursor hairline 15 is set at the percent wagered on the other place pool sharing bet, horse Y, on the C scale 31 of the slideable member 12. Here, the hairline 15 is set above the 20 of the C scale.

Next, the odds on the place scale 33 are used at the hairline 15 which for the example are somewhat between 3 to 1 and 5 to 2. The odds are for horse X to place with horse Y as the other place pool sharing bet.

FIG. 6 provides a suitable basis for discussing the calculation of show odds. It is assumed for purposes of this example that from the tote board at the track, it is determined that the amount in the show pool is $10,000. It is further determined that the amount in the show pool on horse X is $900, that the amount in the show pool on horse Y is $1200 and that the amount in the show pool wagered on horse Z is $900. In order to find the show odds of horse X, if the other show pool sharing bets are horses y and Z, it is first necessary to set the pool amount in the show pool, i.e., 10,000, adjusted to a suitable magnitude, i.e., 1000, above the 100 indicia of the B scale 24 on the base member 11. Then without changing that relationship, the setting reference 29 of the slideable member 12 is set at the amount wagered on horse X found on the A scale, which for this example is 90 since $900 is wagered on horse X.

It is then necessary to add the total amounts bet on the two other horses which are believed to share the show pool, horses Y and Z. Thus, the sum total of the amount bet on horse Y and horse Z is $2100, i.e., the sum of $1200 plus $900. Then, directly below the total amount wagered on the other pool sharing bets, i.e., the amounts wagered on horses Y and Z, or $2100, read the pool percent on the B scale 24, i.e., 21%. Thereafter, as described in connection with the example of FIG. 5, the cursor hairline 15 is set above the percent wagered on the other two show pool sharing bets, horses Y and Z, on the C scale 31 of slideable member 12. Here, the hairline 15 is set above 21 of the C scale.

Thereafter, the odds from the Show scale 32 may be read at the hairline 15 which for our example is about 2 to 1. This represents the show odds on horse X with horses Y and Z as the other show qualifying horses.

The view in FIG. 7 has been provided to illustrate the calculation of win odds for the example where the amount in the win pool is $30,000 and the amount on the horse X is $6300 where it is desired to find the win odds on horse X. In this case. as in the previous examples, the first step is to set the pool amount adjusted to a suitable order of magnitude, i.e., 300 over the indicia 100 on scale B. Next, the hairline 15 on the cursor 14 is set on the A scale 28 on slideable member 13 above the amount wagered on horse X adjusted to a suitable order of magnitude which in this case is 63. The final step is reading the odds on the Win scale underneath the cursor 14 on the Win scale 24. Thus, the answer in this example is 3 to 1.

The view in FIG. 7 also illustrates the use of indicia 30 to compensate for various tax-track take. If the odds read at the hairline 15 are for a take of 16%, the tick mark to the right would indicate the odds for a take of 17% which would be slightly less than 3 to 1 odds and the tick mark to the left would indicate the odds for a take of 15% which would be slightly greater than 3 to 1.

The $ scale 26 can be used to transfer the odds on the Win scale 25 directly to dollars so that a 3 to 1 odds victory on horse X would pay $8 for a $2 bet for the example at hand.

If both of the place qualifying horses or all three of the show qualifying horses are an entry, the place or show odds are calculated in the same manner as the win odds are calculated. If two of the three show qualifying horses are an entry, the show odds of that entry may be calculated by doubling the calculated show odds.

To find the odds for different combinations of pool sharing bets in the previous examples, the other horses of the combination are selected and the appropriate steps in the example are repeated. Thus, the step of setting the A scale 28 based on the total amount in the pool and setting the reference 29 on slideable member 12 at the amount wagered on the horse of interest remains the same. Thereafter, the process is repeated based upon calculations appropriate to the different combination of pool sharing bets selected.

In order to simplify calculations, the largest amount bet on any other horse in the place pool or the largest amount bet on the next two horses in the show pool can be used to provide an indication of minimum odds, following the teaching of the example.

In order to update the input data for changing tote board figures, the A scale 28 is transferred so that the new pool total is above the indicia 100 on the B scale 24 while holding the slideable member 12 and the cursor 14 in place. If the pool percentages of the bets whose odds are being calculated and the other pool sharing bet or bets is unchanged, no other adjustment is necessary. Otherwise, it is necessary to adjust the cursor 14 and/or the setting reference 29 as required, in accordance with the previous examples.

The foregoing specific examples clearly set forth the relationships between the A scale, the B scale, the Win scale, the $ scale, the Place scale, the Show scale and the C scale and the manner in which they are positioned relative to each other on the structural members of the calculator. The various scales have not been illustrated in their entirety in the drawings in order to simplify an understanding of the manner by which the calculator of the subject invention may be used. The various scales may be completed, however, according to the following method.

Once the A scale and the B scale, which are triple logarithmic and double logarithmic scales, respectively, are imprinted upon the calculator, the scale representing win odds is numbered and positioned on the lower base portion 11a by performing a series of mathematical calculations employing Equation (1) and then positioning the indicia of the Win scale relative to the B scale. This is done by substituting in Equation (1) the quantity 1 for the variable X, setting the quantity b equal to zero since only the horse of interest is involved, dividing both the numerator and the denominator of Equation (1) by the quantity p which represents the total amount in the win pool and solving the resulting transformed equation for the quantity $a/p$ or $a'$ which represents the percentage of the win pool wagered upon the horse of interest. The resulting equation is as follows:

$$a' = \frac{.84}{\text{Win} + 1} \qquad (2)$$

Employing this equation, a table may be developed by varying the quantity "Win" which represents the win odds from zero up to any suitable number and solving for $a'$. This resulting table then gives the direct relationship between the percentage bet on the horse of interest and the corresponding win odds. Therefore, the indicia on the Win scale may be positioned by finding the specific percentage $a'$ on the B scale and printing the corresponding win odds indicia directly below this percentage on the Win scale.

Once the positioning of the indicia on the Win scale has been completed, the positioning and numbering of the Show and Place scales may be accomplished directly from the Win scale. This is apparent from Equation (1) in as much as the distribution factor X equals ½ for place and ⅓ for show. By setting the variable b equal to zero in Equation (1) it is seen that the place odds would be equal to ½ the win odds and the show odds will be equal to ⅓ the win odds. Therefore, the spacing of the indicia on the Show and Place scales will correspond to the spacing of the indicia on the Win scale. However, the corresponding numerals imprinted on the Show and Place scales would be ½ the corresponding win odds and ⅓ the corresponding win odds, respectively. The variable $b$ equals the amount of the other bet sharing the place pool profits or the amount wagered on the other two bets sharing the show pool profits. By setting this quantity equal to zero, the direct relationship between the win odds and the place or show odds, permits ready placement of these latter scales on the calculator.

By employing the above method to complete the answer scales, the odds imprinted on the calculator have been compensated to account for the take of the track of interest, which was selected to be 16% of the total pool.

Once the Win, Place and Show scales have been imprinted on the calculator, the C scale may now be completed by employing Equation (1) and the relationship between the B scale and the Place scale. First, Equation (1) may be transformed to obtain the following relationship:

$$a' = \frac{.84 - b'}{1.2} \qquad (3)$$

This equation is obtained by setting the distribution factor X equal to ½, the place odds equal to 0.1 and then solving the resulting equation for $a'$ which represents the percentage of the total place pool wagered on the horse of interest. A value for the place odds other than 0.1 may be selected to obtain an equation for $a'$ as a function of $b'$. This will be apparent from the following discussion.

The quantity $b'$ represents the percentage wagered on the other horse which is expected to share the place pool with the horse of interest. This latter quantity $b'$ is the quantity which is represented on the C scale. A point is then selected on the slideable member 12 toward the righthand end of the calculator, as shown in FIG. 1 and the setting reference 29 is positioned at this point. Due to the fact that the various odds on the answer scales were completed by setting the variable $b$ = zero, the number 0 is positioned at the setting reference 29 on the C scale. A table may now be developed by varying the quantity $b'$ from zero up to a suitable percentage such as 84% and solving the above equation for $a'$ which is the percentage of the total place pool which must be wagered on the horse of interest in order to maintain the place odds at 0.1. Once this table is developed, the location of the indicia on the C scale may be determined by placing the setting reference 29 in line with each percentage $a'$ on the B scale, placing the hairline of the cursor at the numeral 0.1 on the Place scale and then imprinting the corresponding percentage $b'$ on slideable member 12 where it is intersected by the hairline on the cursor. The cursor is maintained in the same position and the setting reference 29 is positioned in line with the various percentages $a'$ and the corresponding indicia $b'$ are imprinted on the slideable member 12 until the C scale is completed. If a value other than 0.1 is selected for the place odds, the method for laying out the C scale would remain the same. The cursor hairline would be set at this other value and the transformed equation relating $a'$ to $b'$ would contain different constants. Once the corresponding table is developed and the indicia imprinted on the calculator, the same spacing and location would be obtained.

The payoffs represented by the $ scale may be imprinted on the lower portion 11a of the base member. This is accomplished by determining the payoffs from the simple equation, payoffs equal (win odds plus 1) times actual dollars wagered, which in the example given is set at a $2 bet. Once these numbers are calculated, they may be imprinted on the $ scale in line with the corresponding win odds. The location of the indicia 30 used to compensate for a tax-track take other than 16% may be determined by using the calculator to determine the win odds for a given total pool and amount wagered and then solving Equation (1) for the win odds employing a different percentage for tax-track take. The indicia 30 would then be placed in line with these computed values.

Figure 8:
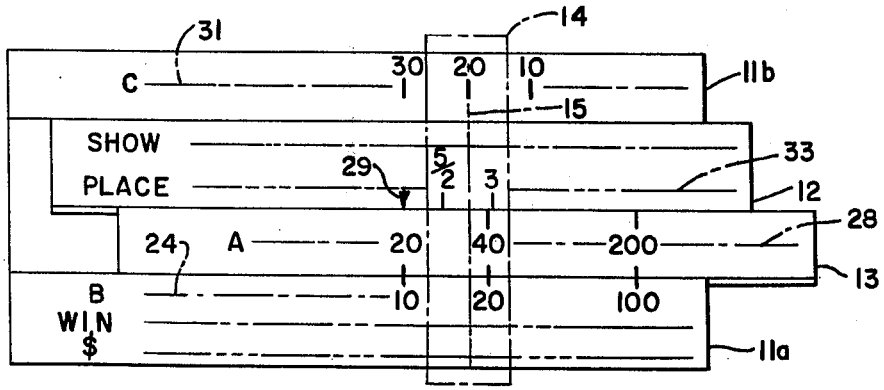
FIG. 8 shows an alternative embodiment wherein the place and show scales are located on the second slideable member and the percentage, or C scale is located on the upper portion of the base member.

FIG. 8 shows an alternative arrangement for the calculator structure shown in FIGS. 1, 5, 6 and 7. Accordingly, reference numerals corresponding to those used in the discussion of those figures have also been used in connection with FIG. 8.

The embodiment of FIG. 8 is substantially similar in construction to the previous embodiments and the description of the method of using the calculator of the invention is substantially applicable to this embodiment. The embodiment of FIG. 8 differs from the previously-described embodiments in that the Place scale 33 and the Show scale 32 are located on a slideable member 12 and the percentage, or C scale 31 representing wagering pool percentage is located on the base 11. The wagering calculations of interest are performed using the embodiment of FIG. 8 according to the description previously presented.

A specific embodiment of the circular form of the invention is shown in FIG. 9 where the reference numerals used are like those in FIGS. 1-8 and are used to describe similar parts.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are intended to be embraced therein.

What is claimed is:

1. A calculator for calculating the odds for a selected entrant in a predetermined wagering pool for one of the different winning positions in the pari-mutuel system of wagering from a knowledge of the total amount of money wagered in said predetermined wagering pool and the amount of money wagered on each of the pool profit sharing entrants, comprising:

a first member having first indicia thereon representative of amounts wagered on each said entrant and the total amount wagered in said pool;

a second member movable relative to said first member, said second member having second indicia thereon for cooperating with said first indicia to determine the percentage of said total amount wagered on one or more of said entrants, said second member further including odds indicia representative of at least one of said different winning positions;

a third member movable relative to said first and second members, said third member having indicia thereon representative of the percentage of amounts wagered on the other entrant or entrants sharing said predetermined wagering pool with said selected entrant, said third indicia including an index; and a cursor movable relative to said first, second, and third members, said cursor having a hairline thereon, said first, second, third, and odds indicia being positioned on said calculator such that when said total amount wagered in said predetermined pool as shown on said first indicia is set adjacent the one hundred percent index on said second indicia, the third indicia index is set adjacent the amount wagered on said selected entrant as shown on said first indicia, and the cursor hairline is set on the percentage of preselected pool-sharing wagers for entrants expected to share in the pool with the entrant of interest on said third indicia, the odds for said selected entrant will be indicated by said hairline on said odds indicia.

2. The calculator of claim 1 wherein said odds indicia on said second member represents place odds for a predetermined entrant.

3. The calculator of claim 1 wherein said odds indicia on said second member represents show odds for a predetermined entrant.

4. The calculator of claim 1 wherein each of said first, second and third members is substantially circular, said members and said cursor being joined together in a rotatable relationship.

5. The calculator of claim 1 wherein said second member further includes indicia representing win odds.

6. The calculator of claim 5 wherein said second member further includes indicia thereon representing the dollar equivalent of a selected one of the win odds, the place odds and the show odds.

7. The calculator of claim 1 wherein said second member is a base member and said first and third members are slideable members secured to said base member.

8. The calculator of claim 1 wherein said cursor includes indicia means for compensating for various tax-track takes.

* * * * *